United States Patent [19]

Fulkerson et al.

[11] 4,315,550

[45] Feb. 16, 1982

[54] SELF-PROPELLED APPARATUS FOR SETTING CEMETERY MARKERS AND THE LIKE

[76] Inventors: David W. Fulkerson, 8360 W. Six Mile Rd., Northville, Mich. 48167; Lawrence W. Smith, 26950 Taft Rd., Novi, Mich. 48050

[21] Appl. No.: 951,578

[22] Filed: Oct. 16, 1978

Related U.S. Application Data

[60] Division of Ser. No. 830,022, Sep. 2, 1977, abandoned, which is a continuation-in-part of Ser. No. 625,141, Oct. 23, 1975, Pat. No. 4,051,684.

[51] Int. Cl.[3] ..... E02D 7/08

[52] U.S. Cl. ..... 173/28; 173/43; 173/46; 173/131; 173/133; 173/139

[58] Field of Search ..... 173/28, 48, 128, 131, 173/133, 43, 46, 139

[56] References Cited

U.S. PATENT DOCUMENTS

| | | | |
|---|---|---|---|
| 1,039,369 | 9/1912 | Eichler | 173/131 |
| 1,140,558 | 5/1915 | Annison | 173/131 |
| 3,172,483 | 3/1965 | Spitzer | 173/28 X |

FOREIGN PATENT DOCUMENTS

| | | | |
|---|---|---|---|
| 7506599 | 12/1976 | Netherlands | 173/131 |
| 473295 | 10/1937 | United Kingdom | 405/232 |
| 224375 | 11/1968 | U.S.S.R. | 173/128 |

*Primary Examiner*—Robert Mackey
*Attorney, Agent, or Firm*—Harness, Dickey & Pierce

[57] ABSTRACT

A wheeled, self-propelled apparatus has a percussion tool or hammer mounted on its forward end and an impact transmitting means carried on the tractor below the hammer. The impact transmitting means is adapted to be mounted to transmit repeated impacts from the hammer to a cemetery marker until the latter is flush with the ground surface where it will not interfere with ground maintenance, such as lawnmowing and the like.

25 Claims, 10 Drawing Figures

26
14
84
28
134
92
82
132
92
130
90
134
25
138
29
136
120
86
92
26
30
80
98
122
130
96
21
94
54
60
59
56
62
124
57
66
58
126
64
50
36
142
22

90
120
122
130
126
96
38
54
50

SELF-PROPELLED APPARATUS FOR SETTING CEMETERY MARKERS AND THE LIKE

This is a division of application Ser. No. 830,022, filed Sept. 2, 1977, now abandoned, which was a continuation-in-part of Ser. No. 625,141 filed Oct. 23, 1975, now U.S. Pat. No. 4,051,684 date Oct. 4, 1977.

The present invention relates generally to a method and apparatus for reducing the cost of maintaining a cemetery and, more particularly, to a self-propelled percussion unit, and method of using same, especially adapted for driving previously installed cemetery markers into the ground so that grass can be cut with a mower running over the cemetery markers with the mower blade operating at a normal cutting height.

In recent years, the cost in maintaining cemeteries has increased dramatically to the point where cemetery maintenance is a real problem. Where cemetery markers were installed projecting above the ground, a self-propelled mower cannot pass over the raised marker when the mower blade is operating in a normal cutting position. The cost to hand trim markers is becoming prohibitive, and mowing costs are substantial if a mower must maneuver around protruding markers. The problem has become so severe that a large number of cemeteries no longer permit a marker to be installed projecting above the ground where it will interfere with a self-propelled mower. Although grass immediately around a grave marker can be controlled by grass killers and the like, this is expensive and still requires that the mower negotiate around the raised markers.

The increase in maintenance cost caused by the raised markers has in some cases been sufficient to justify cemetery workers digging up markers and their foundations, deepening the excavation and then reinstalling the foundation and the marker flush with the ground. This manual operation is time consuming and expensive, and the cost to manually relocate the marker flush with the ground can easily be on the order of $10 to $20 per marker. This cost is almost prohibitive with large older cemeteries having literally thousands of raised cemetery markers.

A principal object of the present invention is to reduce the cost in maintaining cemeteries that presently have cemetery markers projecting above the ground sufficiently to interfere with a self-propelled mower passing over the marker while it is cutting grass.

A further object of the present invention is to provide a self-propelled percussion unit having a specially constructed impact transmitting arrangement that rapidly and effectively drives cemetery makers flush with the ground at relatively low cost, without damaging the marker, and in a relatively short time compared to prior manual marker relocation techniques; that is usable with markers of various different configurations; and/or that can be constructed by relatively simple modification of existing percussion units presently used for other purposes.

A further object of the present invention is to provide a method for relocating cemetery markers of the type referred to above in a manner that is simple, usable with a wide variety of marker configurations, relatively low in cost by comparison to prior manual techniques, that will not damage the markers and/or that can be readily implemented by relatively simple modification of existing percussion units presently used for the other purposes.

Other objects, features and advantages of the present invention will become apparent in connection with the following description, the appended claims and the accompanying drawings in which:

Figure 1:
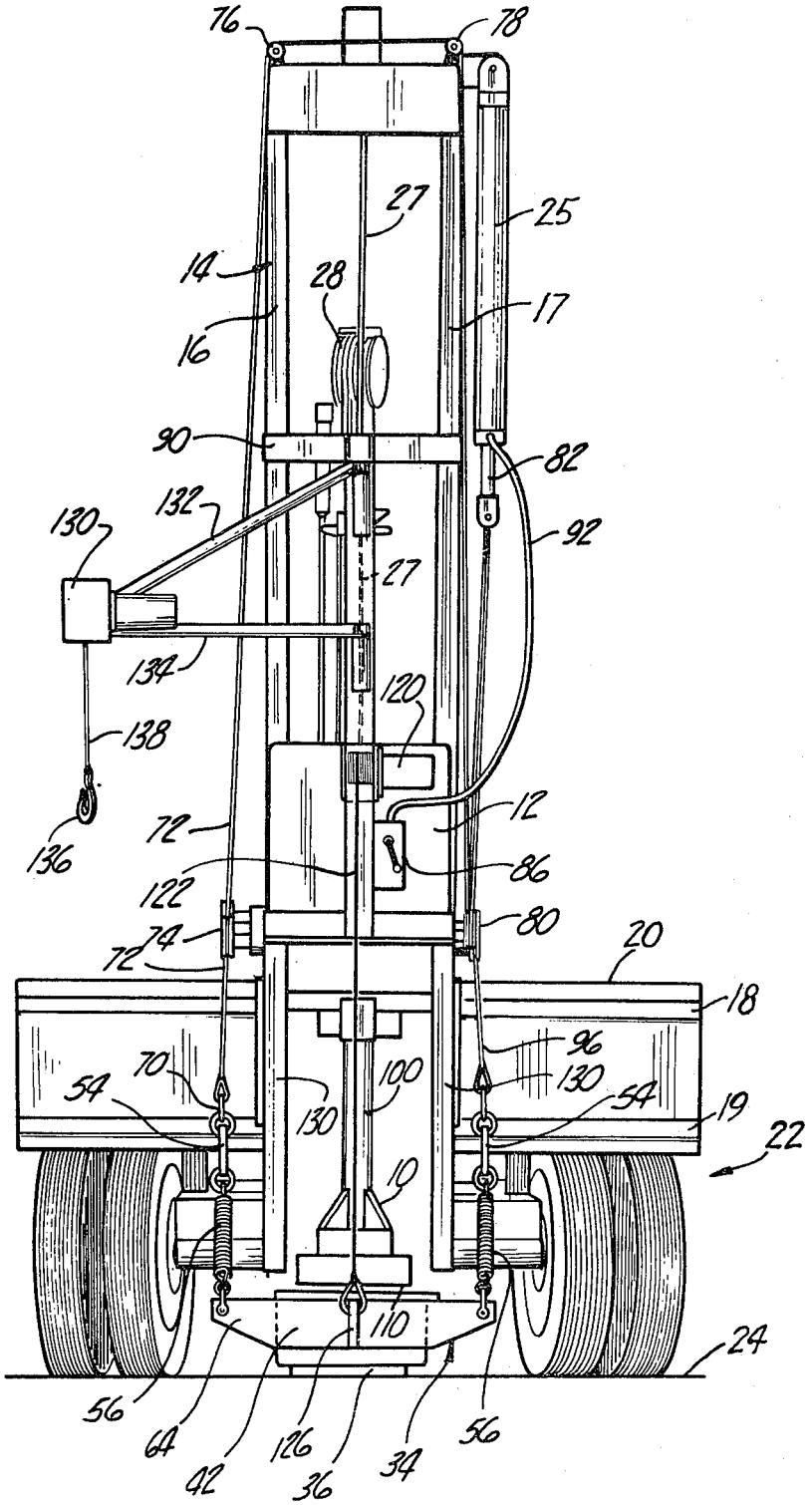
FIG. 1 is a front view of a self-propelled persucsion unit for driving cemetery markers into the ground according to the present invention.

Referring to the drawings in general, a hammer 10 is carried at the lower end of a heavy weight 12 which is longitudinally reciprocally mounted on a track or tower 14 comprising first and second laterally spaced inwardly tapering track members 16, 17 slidably received in corresponding channels in the weight side edges. Tower 14 is carried on tracks 18,19 for transverse positioning relative to a frame 20 which, in turn, is carried by a hinge bracket 21 for pivotal movement in a vertical plane. Track 14 is additionally carried for pivotal adjustment in the direction of the plane of track members 16, 17 by means not shown between track 14 and frame 20. Bracket 21 is carried by self-propelled wheel vehicle 22 for translocation of the apparatus over the earth surface 24. A hydraulic ram 25 is carried by a support bracket 26 on vehicle 22 and is powered by the vehicle engine (not shown) to lift hammer 10 and weight 12 by means of a cable 27 trained over suitable idler pulleys 28. Additionally, lateral adjustment of track 14 with respect to frame 20 and pivotal adjustment with respect to bracket 21 are powered by hydraulic rams (not shown). The various hydraulic systems, including ram 25, are interconnected by hoses 29 and are selectively controlled by an operator of vehicle 22, as by a control handle 30.

With the exception of modifications to be hereinafter described, the arrangement and contruction thus far set forth may be substantially identical to that described and disclosed in U.S. Pat. No. 3,172,483, granted Mar. 9, 1965, which patent is incorporated herein by reference. Self-propelled percussion units of this general type are well known for a multiplicity of uses, for example, tamping fills, cutting and breaking pavement, driving posts and pilings, and the like, and are available from several manufacturers including the Arrow Manufacturing Company of Denver, Colo. to which the aforementioned U.S. Pat. No. 3,172,483 was assigned. When an operator initially energizes ram 25, cable 27 is retracted to move weight 12 and hammer 10 upwardly on opposed track members 16,17 to a raised position, generally anywhere from an inch or so up to several feet, for example eight feet, above the earth surface. At this point, the hydraulic system releases weight 12 so that it falls freely by force of gravity to develop a high impact force at hammer 10. Typically, weight 12 might be on the order of one thousand pounds or more.

In conventional percussion units, the controls of the hydraulic systems are arranged such that, once the operator initiates the operation, the cylinder will be cycled repeatedly until the operator deactivates the control. According to one aspect of the present invention, the hydraulic control is modified so that the weight 12 and hammer 10 are raised and dropped only once each time the operator actuates the control, as by control handle 30. This is a very simple modification that can be accomplished by by-passing the automatic sequencing valve. Aside from this minor modification and the modification of the hammer as will be described, the above described percussion unit may be otherwise substantially identical to the aforementioned commercially available units.

According to a first aspect of the present invention, the commercially available percussion unit is modified by adding an impact transmitting member 34 that can be raised and lowered independently of hammer 10 and can be positioned below hammer 10 on top of a cemetery grave marker 36. More particularly, the member 34 comprises a generally rectangular frame 38 having a pair of side or end plates 40, front and rear plates 42, 43 and top plate 44. The plates are securely welded together to form a downwardly opening cavity 46 in which wood timbers 48 are mounted so as to fill the cavity and project below plates 41, 42, 43 and form a flat, lower cushion surface 50 for engaging directly against marker 36. The frame 38 and particularly the top plate 44 must be rigid, strong and hard to withstand repeated severe impact forces from hammer 10. In one embodiment of the present invention, top plate 44 was a 2-inch thick steel plate, 26 inches in depth (in a direction longitudinally of the wheeled tractor 22) and 22 inches wide (in a direction transversely of the tractor 22). Plates 40, 42, 43 are formed of 1-inch thick steel plate, 4 inches tall so that the cavity 46 can accommodate two 8"×10"×24" wood timbers of generally rectangular cross section with the upper surface of the timbers bottomed against the lower surface of top plate 44. Although the timbers can be maintained in the cavity by making them slightly oversized and driving them in place, preferably they are held in place on the frame 38 by a pair of bolts 52 that extend transversely through the timbers and the side plates 40. Although various types of wood timbers could be used, it has been found that elm timbers operate very effectively since, although very soft in comparison to steel, elm is a relatively hard wood that will withstand repeated impact against the marker without splitting and splintering.

Figures 2, 3:
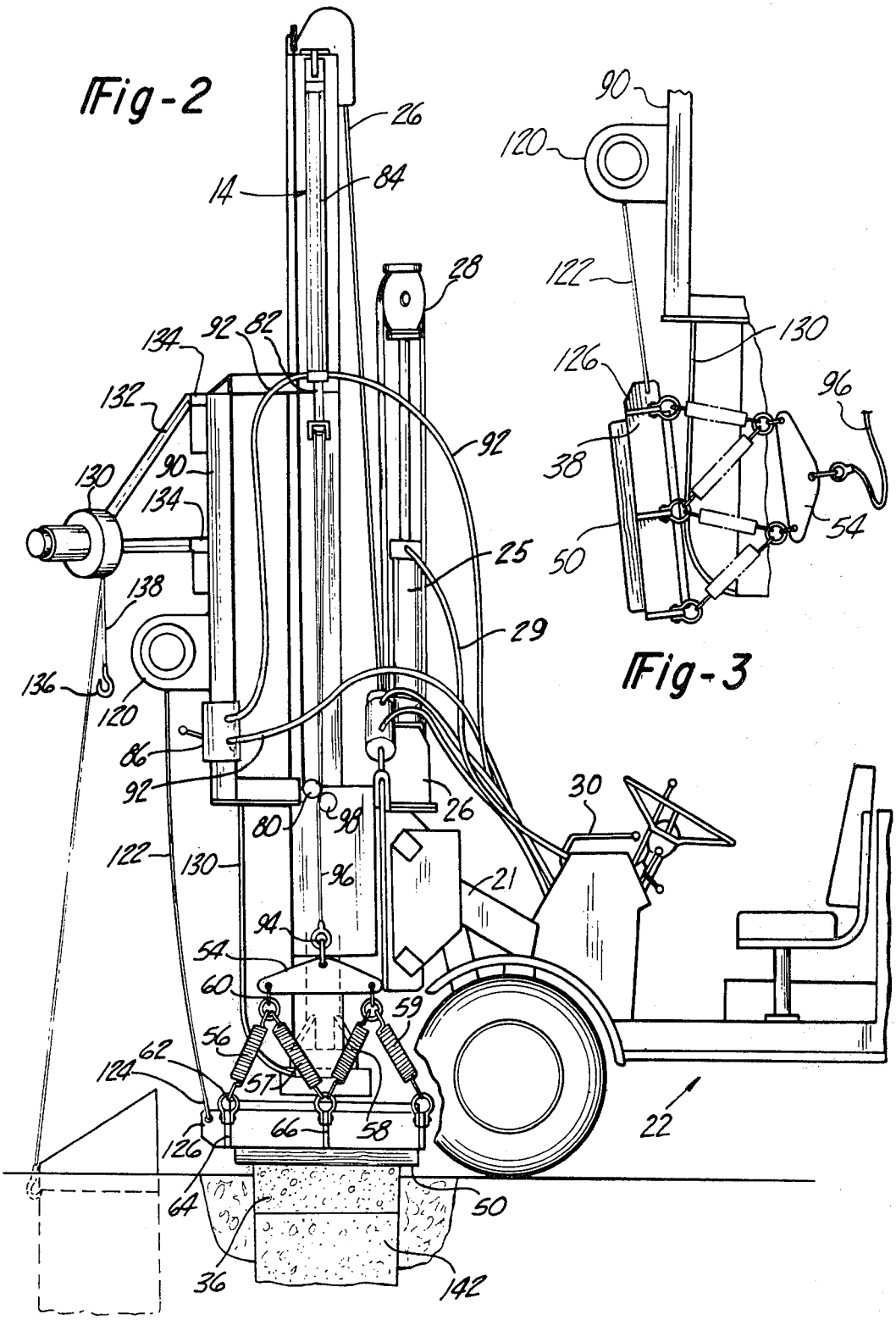
FIG. 2 is a side elevational view of the front portion of the self-propelled unit shown in FIG. 1.
FIG. 3 is a fragmentary side view showing an impact transmitting means of the present invention, swung forwardly and upwardly from its position illustrated in FIG. 2.

Frame 38 is connected to a pair of triangular hanger plates 54 located, respectively, at opposite sides of tower 14 by means of four tension springs 56, 57, 58, 59 at each plate 54 as best shown in FIG. 2. The front spring 56 is fastened at its upper end to the front of plate 54 by rings 60 and at its lower end via ring 62 to a laterally extending lug 64 on the front plate 42. The rear spring 59 is similarly fastened to the rear of hanger plate 54 and the rear wall 43. The center two springs 57, 58 are connected at their top ends, respectively, to the front and rear of hanger plate 54 and at their lower ends to a lug 66 welded on the sidewall 40 midway between the front and rear walls. An identical spring arrangement is provided at the opposite side of frame 38. As will later be more apparent, the spring arrangement insures that the frame can maintain a horizontal position when placed against the top surface of markers having different configurations and also permits the frame to move downwardly against the tension of the springs when the plate 44 is impacted by hammer 10.

The hanger plate 54 at the left side of tower 14 as viewed in FIG. 1 is pivotally connected at 70 to the lower end of a cable 72 which passes upwardly in a straight run over an idler pulley 74 with the cable continuing upwardly and over a pair of pulleys 76, 78 at the top of tower 14, and then downwardly around a further pulley 80 (FIG. 2) and then back upwardly where it is fastened at its other end to the piston 82 of a hydraulic cylinder 84 mounted on the hammer tower 14. Cylinder 84 is controlled by a hand operated valve 86 mounted on a front frame 90 carried on tower 14. Suitable hydraulic interconnections can be provided as illustrated by the hydraulic lines 92 interconnecting the cylinder 84, the control valve 86 and the hydraulic pressure system (not shown) so that a worker can actuate cylinder 84 while he is standing in front of or at the side of tower 14 to raise and lower frame 38. In a similar fashion, the hanger plate 54 at the right of tower 14 as viewed in FIG. 1 is connected at 94 to the lower end of a cable 96 that passes upwardly between an idler pulley 98 and a second groove on the pulley 80 with the upper end of cable 96 being connected to piston 82. With this arrangement, when piston 82 is actuated, cables 72, 96 move in unison to raise and lower frame 38 while the lower surface 50 of the timbers stays in substantially a horizontal plane.

Figure 4:
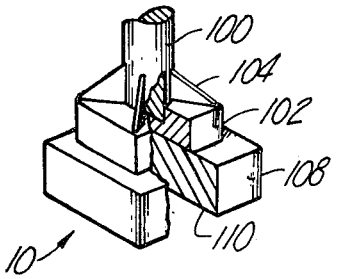
FIG. 4 is a perspective view, partly broken away and in section, of a lower end of a hammer on the percussion unit.
Figure 5:
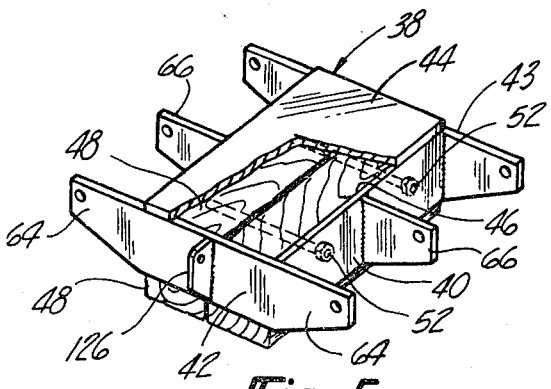
FIG. 5 is a perspective view, partly broken away and in section, of the impact transmitting means.

Referring now to FIGS. 1, 2 and 4, as indicated earlier, the hammer portion of the commercially available percussion units has been modified slightly according to the present invention to better withstand repeated battering against the top plate 44 of the frame 38. The weight 12 is fastened at its lower end to a vertical column 100 that, in turn, has its lower end welded in a 2-inch thick steel block 102 with four reinforcing struts 104 being welded to column 100 and block 102 at positions equally spaced circumferentially about the column to further reinforce the hammer 10. Block 102 is, in turn, welded to a larger 2-inch thick steel block 108. Block 108 has a cross section in a horizontal plane of about 10 inches by 10 inches and has a flat lower face 110 for impacting against the top face 44 on the frame 38. Since the horizontal area of block 108 is substantially smaller than the area of plate 44, frame 38 can be manipulated so that hammer 10 strikes plate 44 at selected locations. On the other hand, plate 44 distributes the concentrated impact of hammer 10 over larger areas for impacting marker 36. In this regard, the area of timber surface 50 is slightly larger than a typical cemetery marker.

Also mounted on frame 90 slightly forward of the tower 14 is an electric motor-driven wench 120 having a cable 122 that is pivotally fastened at 124 on a lug 126 welded on the front plate 42. A pair of curved guide rails 130 are mounted at their lower end on tower 14 and at their upper end on frame 90 so as to project slightly forward of the hammer 10 and guide the frame 38 forwardly when it is raised upwardly by retracting cable 122. As shown in FIG. 3, the frame 38 can be raised completely out of the way of hammer 10 as may be required during travel of tractor 22 or so that hammer 10 can be used for other purposes. With some lightweight markers such as sandstone, limestone or deteriorated markers, or in other situations justifying such procedure in the opinion of the operator, the marker can be removed and the foundation 142 driven down with hammer 10 and then the stone replaced. Additionally, cable 122 can be used to slightly tilt the frame 38 if required for driving a particular type of cemetery marker.

A further electric wench 130 is also mounted on the frame 90 by means of struts 132 which are pivotally connected to the frame 90 at 134. A hook 136 is fastened at the lower end of a cable 138 of wench 130. In working with cemetery markers, it is frequently convenient to have a separate power-driven wench that can be used to assist the workman in dislocating, reorienting or even moving the marker as illustrated generally in broken lines in FIG. 2.

Figure 6:
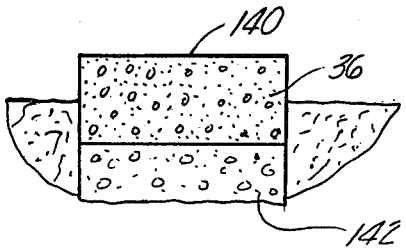
FIGS. 6–10 are views schematically illustrating the manner in which two different types of markers and their foundations can be driven into the ground according to the present invention.
Figure 7:
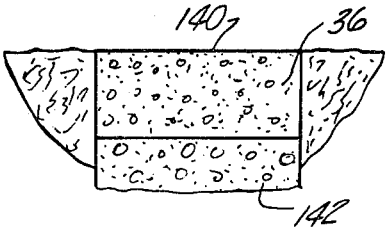

In using the self-propelled unit of the present invention, the tractor 22 is driven to the site of a marker 36 (FIGS. 1, 6 and 7) and positioned so that the hammer 10 is located directly above the center of the top surface 140 of the marker. Usually, the markers will be in a row extending the direction of travel of tractor 22 so that the long dimension of the marker 36 corresponds to the long dimension of frame 38 and tractor 22 straddles the row of markers. As illustrated schematically in FIG. 6, the marker extends or projects upwardly above the ground surface to a height where it would interfere with the passage of a lawn mower over the marker when the mower blade is operating at a normal cutting height. Flat rectangular markers of the type shown in FIG. 6 may be 12 inches by 24 inches, made of granite or marble, and typically project from 4 to 6 inches above the ground but could be as high as say 14 inches. As also illustrated in FIG. 6, marker 36 is typically installed on top of a foundation 142 which would have to be dug up manually if one attempts to relocate the marker 36 manually. The exact nature and arrangement of the foundation 142 varies greatly depending, in part, for example, on location, the practice at the cemetery involved, soil conditions and the year in which it was originally installed. The foundation might be a concrete pad 6 to 8 inches thick or, in some instances, it can be a concrete footing that extends a substantial depth of up to 42 inches, for example.

When hammer 10 is positioned over marker 36 and frame 38 centered over the marker, and hence centered with respect to the hammer, the frame is lowered by lowering cables 72, 96 until the bottom surface 50 of timbers 48 engages with the top surface 140 of the marker. In the preferred mode of operation, the cables are adjusted so that the springs 56-59 are in tension and supporting some of the weight of the frame and so that plate 44 is horizontal or parallel with the bottom surface 110 of hammer block 108. This insures that the hammer 10 will strike the top plate 44 over the entire interface therebetween; and if the marker is tipped slightly, the impact will tend to level the top surface of the marker as it is driven downwardly. After the frame is positioned, the operator on tractor 22 actuates handle 30 to move hammer 10 and weight 12 to their raised position, at which point the weight is automatically released. The impact of hammer 10 on plate 44 is transmitted via timbers 48 to marker 36, driving it and foundation 142 downwardly into the ground. After each impact, the operator on the tractor will again actuate the cylinder 84 to raise the weight 12 and hammer 10 and repeatedly impact frame 38 and marker 36 until the foundation and marker are driven downwardly to a level where the top surface 140 is substantially flush with the ground.

A typical marker that might extend 4 to 6 inches above the ground can be pounded flush with the ground with one to five impacts by hammer 10 which will take only a matter of seconds or, at most, several minutes. The unit is preferably manned by an operator on tractor 22 to operate hammer 10 via cylinder 84 and a second workman standing in front or at the side of the percussion unit so that he can make sure that the frame 38 remains properly positioned as the marker is driven flush with the ground. The workman standing at the front of the unit can, via valve 86, progressively lower cables 72, 96 to maintain timbers 48 horizontal and in engagement with the marker and true to the hammer while keeping the springs 56-59 slightly tensioned. As indicated earlier, if a marker is slightly tilted, by keeping the frame 38 horizontal, the impact will be concentrated at the high side of the marker and will, as the marker is driven into the ground, level the top surface of the marker. Where this is not fully accomplished, as the marker is driven downwardly, the operator on the tractor can change the vertical orientation of the tower 14 and the workman at the front of the percussion unit can maneuver the frame 38 so that the impact is transmitted directly to the high side of the marker. This technique is also useful where the terrain is not level and it is desired to have the top surface of the marker conform to the terrain. After one marker is pounded into the ground, tractor 22 is driven to the next marker and it is pounded into the ground in the manner described hereinabove.

Figure 8:
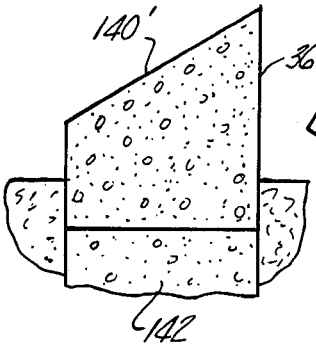
Figure 9:
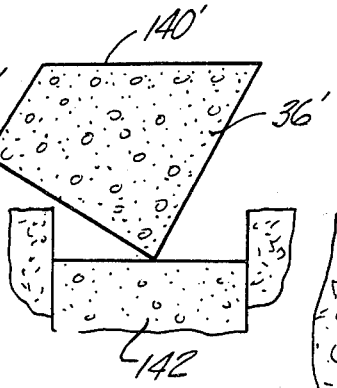
Figure 10:
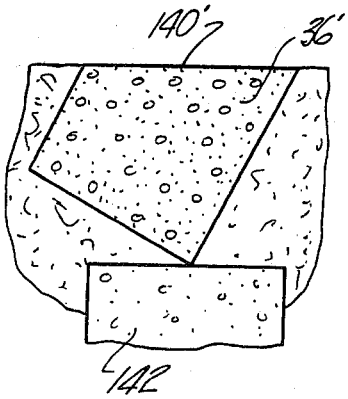

Referring to FIGS. 8, 9 and 10 which illustrate another type of cemetery marker 36' having an inclined top surface 140', the hook 136 and cables 138 can be used to lift or raise the front edge of the marker 36 and tilt it backward to the position illustrated in FIG. 9. The workman can then center the tilted marker 36' and align it with other markers. With the marker tipped as shown in FIG. 9, the workman lowers the frame 38, while keeping it horizontal, and lets it rest on the top surface 140'. In most cases, the weight of the frame and the tension in springs 56–59 are such that marker 36' will stay in the tilted orientation as it is driven downwardly until the top surface 140' is substantially flush with the ground as illustrated in FIG. 10. When a marker is tipped as illustrated in FIGS. 8–10, the marker 36' and foundation 142' may crumble or fracture slightly at the interface therebetween. However, it has been found that this does not usually cause any visible damage to the marker once it is in place. It is usually desirable to back fill under the bottom face of a tipped marker 36' before it is driven to prevent settling.

Although the operation of the percussion unit has been described hereinabove in two examples wherein the springs 56–59 at both sides of the frame 38 are preferably kept tensioned, it will be apparent that the principal purpose of the springs is to permit the workmen to keep the frame 38 horizontal and trued relative to the hammer 10, which, in turn, will tend to drive the high side of the marker downwardly, leveling the marker and insuring that the full force of the hammer 10 strikes the plate 44 directly. This also minimizes stresses on hammer 10 and tends to reduce secondary impacts that might be caused by a wobble at the frame. In order to achieve these objectives, depending on the circumstances, it may be necessary or desirable to permit the springs, at least at one side of the frame, to relax. On the other hand, where the top surface of the marker is substantially level before it is driven, the marker could be driven with the springs slack. However, it is preferred to keep the springs 56–59 at least slightly tensioned since the springs also tend to prevent the frame 38 from becoming misaligned with the marker.

One of the more important aspects of the present invention is the recognition and implementation thereof that a percussion tool can effectively drive cemetery markers flush with the ground in a simple and effective manner without damage to the marker. Before the practicality of the present invention was established by extensive testing, it was not at all certain that markers could be driven by brute force without substantial damage, if not complete fracturing, of the marker. However, based on the experience of driving hundreds of markers, it is estimated that the breakage is perhaps about one percent or less. Breakage is more likely to occur with slant-faced markers such as that shown in FIGS. 8–10, particularly where the marker is high or the angle of the slant face is great. Generally, sandstone and limestone markers should be removed and the foundations driven separately. Breakage can be reduced by exploring the area under the marker and foundation with a long steel rod if the marker does not move with a couple of blows. If the foundation bottoms on a large buried object, such as a large rock or vault, it may then be necessary to reposition the marker manually; but this does not occur very often.

Another important feature of the present invention is that the use of a wooden cushioning pad provided by timbers 48 eliminates scarring of face 140 of the marker 36 which would, of course, be undesirable. Additionally, the cushioning effect of the soft wood distributes the impact force over the entire surface of the marker to minimize fracturing the marker. The construction described hereinabove has proved very effective in driving numerous different configurations of markers without scarring, fracturing or otherwise damaging the markers.

Although various types of percussion tools capable of driving a hard blow could be used, a percussion tool having a heavy weight on the order of 1000 pounds is preferred and can provide the necessary driving force for a wide variety of conditions. The specific height to which weight 12 is lifted and the number of impacts depends on a number of factors including soil types and soil conditions, principally moisture content. By way of further illustration, when driving a marker and its associated foundation in moist loam soil, weight 12 might be lifted only 1 to 4 inches and just slightly higher for sand, for example, 1 to 6 inches. In heavier soils, weight 12 might be lifted from 1 inch to 2 feet in the case of sandy clay and from 1 inch to 4 feet in the case of clay. Hence, generally speaking, the impact will be the equivalent of dropping a 1000-pound weight a distance in the range of from 4 inches to 2 feet. A lighter weight, for example, a 500-pound weight, raised a higher distance could be used; but the heavier 1000-pound weight is preferred to reduce bouncing and secondary impact between hammer 10 and plate 44 and between timbers 48 and marker 36.

The present invention also contemplates mounting frame 38 on tower 14 by means other than a cable-spring suspension system. However, the cable-spring arrangement is preferred because it allows the operator flexibility is positioning frame 38 relative to the marker and hammer 10 and it can absorb the shock associated with an impact without unnecessary stress on the suspension system.

It is estimated that in areas of low labor costs, a marker can be driven into the ground using the method and apparatus of the present invention at a cost that would be equal to about the cost to trim the marker for a two or three year period. In higher labor cost areas, the markers can be driven flush with the ground with the present invention at approximately the same cost to hand trim the markers over one season. Of course, once the marker is driven flush with the ground, maintenance costs are reduced substantially since the cemetery can be kept neat appearing with self-propelled mowers that can pass over the markers with the cutting blade operating at a normal cutting height of say about 2 to 4 inches.

We claim:

1. In a combination wheeled unit comprising a self-propelled wheeled vehicle and a vertically upstanding hammer tower carried on said vehicle, said hammer tower having a vertically reciprocal hammer thereon arranged and constructed to provide a generally downwardly directed percussion blow, that improvement especially adapted for driving previously installed cemetery markers downwardly into the ground to be substantially flush with the ground so as to permit a grass mower to pass over said markers with the cutting blade of the mower operating at a normal cutting height, said improvement comprising force transmitting means, mounting means supporting said force transmitting means on said unit for movement relative to said hammer and said hammer tower, said force transmitting means being positionable beneath said hammer over a cemetery marker, said force transmitting means comprising an upper hard, rigid flat surface portion adapted to be impacted by said hammer and a lower flat surface portion that is substantially softer and less rigid than said upper portion for engagement with an upper surface of a cemetery marker, said lower portion being integrally connected with said hard upper portion so as to transmit impact forces from said hammer to a marker positioned beneath said lower portion, said supporting means operatively supporting said force transmitting means independently of said hammer for retractable movement between an operating position wherein the plane of said force transmitting means is arranged generally perpendicular with the path of reciprocable movement of said hammer so that said force transmitting means will be engaged upon downward movement of said hammer, and a non-operating position wherein the plane of said force transmitting means is arranged generally parallel to and spaced laterally away from the path of reciprocable movement of said hammer so that force transmitting means will not be engaged by said hammer upon downward movement thereof.

2. The improvement set forth in claim 1 wherein said upper portion is a steel plate and said lower portion is substantially softer than steel.

3. The improvement set forth in claim 2 wherein said lower portion is wood.

4. The improvement set forth in claim 3 wherein said lower portion is elm wood.

5. The improvement set forth in claim 1 wherein said hammer has a first predetermined bottom surface area, said force transmitting means has a lower bottom surface area substantially greater than said first surface area and generally corresponding to the area of a marker being driven so as to distribute a small area impact by said hammer over a large surface area of said marker.

6. The improvement set forth in claim 1 wherein said force transmitting means comprises a frame and said means supporting said force transmitting means comprises at least two cables coupled at their lower ends to opposite sides of said frame, cable retracting means mounted on said tower with the upper ends of said cables being operatively connected to said cable retracting means to retract said cables and lift said frame.

7. The improvement set forth in claim 6 wherein said cables support said force transmitting means so that a flat lower surface thereof lies in a horizontal plane and wherein said cable retracting means is arranged and constructed to retract both cables in unison so that said lower surface of said force transmitting means remains in a substantially horizontal plane as said force transmitting means is raised and lowered.

8. The improvement set forth in claim 6 wherein each side of said frame is connected to an end of its associated cable by means of at least two tension springs.

9. The improvement set forth in claim 6 wherein said cable retracting means comprises a hydraulically actuated piston connected to the upper ends of said cables.

10. The improvement set forth in claim 9 further comprising a cable wench mounted on said tower and having a cable arranged and constructed for coupling to a cemetery marker to lift at least one edge of the marker out of the ground.

11. The improvement set forth in claim 1 wherein said means supporting said force transmitting means includes at least two tension springs connecting said force transmitting means to said unit so that said force transmitting means can move downwardly against the tension in said springs when the hammer strikes said force transmitting means.

12. The improvement set forth in claim 11 wherein said springs are sufficiently rigid to support said force transmitting means at selected horizontal positions above the ground.

13. The improvement set forth in claim 1 wherein said means supporting said firce transmitting means includes means arranged adjacent the forward end of said vehicle and comprises a cable wench mounted on said tower with the cable of said wench having its lower end operatively connected to said force transmitting means to effect upwardly swinging movement thereof.

14. The improvement set forth in claim 13 further comprising guide means mounted on the lower end of said tower and extending forwardly of said hammer when said hammer is in a lowered position for guiding said force transmitting means forwardly of said hammer when said force transmitting means is raised by said cable wench.

15. The improvement set forth in claim 1 wherein said force transmitting means comprises a generally rectangular frame having a front wall, a back wall, a pair of sidewalls and a top wall defining a downwardly opening cavity, said top wall being a steel plate, a plurality of wood timbers mounted in said cavity with upper surfaces of said timbers being engaged directly against a lower surface of said steel plate and with lower surfaces of said timbers lying generally in a horizontal plane located below said front, rear and sidewalls.

16. The improvement set forth in claim 15 wherein said steel plate has a width in the direction laterally of said wheeled vehicle of at least about 20 inches and a depth in a direction longitudinally of said vehicle of at least about 2 feet and wherein at least two wood timbers are mounted in said cavity with a height of each timber being at least approximately 8 inches.

17. The improvement set forth in claim 1 wherein said hammer can develop an impact force at least approximately as great as the impact force developed by dropping a 1000-pound weight a vertical distance of at least approximately 6 inches, and wherein said force transmitting means includes a flat rigid steel plate disposed beneath said hammer with said plate being sufficiently hard and rigid to withstand repeated impacts by said hammer.

18. In a combination wheeled unit comprising a self-propelled vehicle and a vertically upstanding hammer tower carried on said vehicle, said hammer tower having a vertically reciprocal hammer thereon arranged and constructed to provide a generally downwardly directed percussion blow, the improvement comprising shock-transmitting means, mounting means supporting said shock-transmitting means on said unit for movement relative to said hammer and said hammer tower, said shock-transmitting means being positionable beneath said hammer to engage means to which hammer impact is to be transmitted, said shock-transmitting means comprising an upper hard rigid flat surface portion adapted to be impacted by said hammer and a lower surface portion that is substantially softer and less rigid than said upper portion for engagement with an upper surface of said means to which said impact is to be transmitted, said lower portion being integrally connected with said hard upper portion so as to transmit impact forces from said hammer, said supporting means operatively supporting said shock transmitting means independently of said hammer for retractable movement between an operating position wherein the plane of said shock transmitting means is arranged generally perpendicular with the path of reciprocable movement of said hammer so that said shock transmitting means will be engaged upon downward movement of said hammer, and a non-operating position wherein the plane of said shock transmitting means is arranged generally parallel to and spaced laterally away from the path of reciprocable movement of said hammer so that shock transmitting means will not be engaged by said hammer upon downward movement thereof.

19. The improvement set forth in claim 18 wherein said upper portion is a steel plate and said lower portion is substantially softer than steel.

20. The improvement set forth in claim 19 wherein said lower portion is wood.

21. The improvement set forth in claim 20 wherein said lower portion is elm wood.

22. The improvement set forth in claim 18 wherein said hammer has a first predetermined bottom surface area, said shock-transmitting means has a lower bottom surface area substantially greater than said first surface area so as to distribute a small area impact by said hammer over a large surface area.

23. The improvement set forth in claim 18 wherein said shock-transmitting means comprises a generally rectangular frame having a front wall, a back wall, a pair of sidewalls and a top wall defining a downwardly opening cavity, said top wall being a steel plate, a plurality of wood timbers mounted in said cavity with upper surfaces of said timbers being engaged directly against a lower surface of said steel plate and with lower surfaces of said timbers lying generally in a plane located below said front, rear and sidewalls.

24. The improvement set forth in claim 23 wherein said steel plate has a width in the direction laterally of said vehicle of at least about 20 inches and a depth in a direction longitudinally of said vehicle of at least about 2 feet, and wherein at least two wood timbers are mounted in said cavity with a height of each timber being at least approximately 8 inches.

25. The improvement set forth in claim 18 wherein said hammer can develop an impact force at least approximately as great as the impact force developed by dropping a 1000-pound weight a vertical distance of at least approximately 6 inches, and wherein said shock-transmitting means inclues a flat rigid steel plate disposed beneath said hammer with said plate being sufficiently hard and rigid to withstand repeated impacts by said hammer.

* * * * *